US005901485A

United States Patent [19]

Kiggins

[11] Patent Number: 5,901,485

[45] Date of Patent: May 11, 1999

[54] SPINNING MERCHANDISE DISPLAY SUPPORT

[75] Inventor: Timothy Reed Kiggins, Syracuse, N.Y.

[73] Assignee: Pass & Seymour, Inc., Syracuse, N.Y.

[21] Appl. No.: 08/889,788

[22] Filed: Jul. 8, 1997

[51] Int. Cl.[6] ..... G09F 11/02

[52] U.S. Cl. ..... 40/506; 40/657

[58] Field of Search ..... 40/506, 602, 657, 40/720, 747; 248/220.31, 220.41, 222.41

[56] References Cited

U.S. PATENT DOCUMENTS

| | | | |
|---|---|---|---|
| 2,460,328 | 2/1949 | Young | 40/506 X |
| 3,204,776 | 9/1965 | Brown et al. | 248/222.41 X |
| 3,409,260 | 11/1968 | Bleed | 248/220.31 X |
| 4,146,984 | 4/1979 | Lindquist | 40/800 X |
| 4,405,051 | 9/1983 | Thalenfeld | 40/657 X |
| 4,467,926 | 8/1984 | Percival | 248/220.31 X |
| 4,606,467 | 8/1986 | Everett | 248/220.31 X |
| 5,046,274 | 9/1991 | David | 40/493 X |
| 5,080,516 | 1/1992 | Ward | 40/506 X |
| 5,185,948 | 2/1993 | Markson | 40/506 |
| 5,347,734 | 9/1994 | Howell et al. | 40/506 |
| 5,701,694 | 12/1997 | Atkinson | 40/493 |

*Primary Examiner*—Joanne Silbermann
*Attorney, Agent, or Firm*—Bond, Schoeneck & King, LLP; Stephen B. Salai

[57] ABSTRACT

Display panels containing an item of merchandise for visual and tactile inspection by shoppers in a retail setting or containing advertising, promotional, or instructional indicia are mounted upon a carousel spinnably supported upon a support member which is attachable to a fixed support conventionally present in a retail store. The carousel is provided with securing members designed to hold indicia cards as well as items of merchandise regardless of whether the carousel is held horizontally or vertically. Two types of support members, for alternative use, are described. A first of the support members includes one pair of mounting hooks attached to a mounting bar attached to one stem of the support member, and a second pair of hooks attached to a mounting bar removably attached to a second stem of the support member for securing the carousel to a pegboard. A second of the support members includes a pair of mounting devices for releasably attaching the support member to a conventional track member defining spaced channels extending along a forward edge of a store shelf.

19 Claims, 7 Drawing Sheets

SPINNING MERCHANDISE DISPLAY SUPPORT

FIELD OF THE INVENTION

The present invention relates to supports for the display of items of merchandise in a retail setting. More particularly, the invention relates to hardware for supporting a plurality of items of merchandise and/or display panels to permit visual and tactile examination by customers of merchandise items in a location where such items are normally stocked in packaged form and to provide a location for advertising, promoting, or providing instructions to customers on the items being displayed.

BACKGROUND OF THE INVENTION

Many types of relatively small (e.g., hand-held) items are stocked on store shelves in boxes or cartons from which the item must be removed for visual and tactile examination by the shopper. Some types of packaging are designed to permit viewing of portions of the item, e.g., by blister or shrink packaging wherein the item is covered by transparent plastic affixed to an opaque card. However, the items are normally not viewable from all sides and may not be physically handled outside the package, as is often desirable, e.g., with items having parts intended for manual manipulation under conditions of actual use. Furthermore, when such items are stocked on pegs or shelves there is little or no room for advertising, promotional, or instructional material in the general area of the items without obstructing the space allocated for stocking the items. Advertising and promotional posters are typically pasted to the top or bottom shelf in a retail aisle making the posters difficult to read and making it frustrating for a customer trying to identify the item of merchandise to which the poster corresponds. Instructional materials are rarely available, and if available, are usually generic in nature and placed in an "out of the way" area not easily locatable by the customer.

Therefore, there is a need for a simple and economical, yet highly effective and versatile means of displaying merchandise items in a retail environment. There is further a need for a device which can support advertising, promotional, or instructive materials in the vicinity of the merchandise items being displayed without obstructing the items stocked on the shelves for sale. There is further the need for a display device which can support a plurality of display panels at one time and which is designed for simple interchangeability of such display panels. There is further the need for such a display device which permits selective mounting upon either a vertical surface having preformed holes therein, or upon a conventional track or channel member on the front edge of a store shelf.

SUMMARY OF THE INVENTION

Thus, it is a principal object of the present invention to provide a simple and economical, yet highly effective and versatile means of displaying merchandise items in a retail environment.

A further object is to provide a physical support for items of merchandise to permit both complete visual inspection and manual manipulation of moveable parts by a prospective purchaser.

A further object is to provide a display device which can support advertising, promotional, and/or instructive materials as well as items of merchandise.

A further object is to provide a display device in the form of a carousel which makes all supported display panels visible with a simple turn.

Another object is to provide a merchandise display apparatus which permits selective mounting upon either a vertical surface having preformed holes therein, or upon a conventional track or channel member on the front edge of a store shelf.

Other objects will in part be obvious and in part appear hereinafter.

In a preferred embodiment of the present invention, a display apparatus for displaying to shoppers in a retail store environment multiple display panels, each display panel having at least one substantially planar surface, comprises a carousel and a support member. The carousel preferably comprises a first plate and a second plate, parallel to the first plate, each plate having a hole; at least three display panel holders, each holder separating the first plate from the second plate; and at least one securing member on each holder adapted to support a substantially planar surface of a display panel to the carousel. The support member preferably comprises a spinning bar passing through each hole of the first and second plate, the spinning bar having a first and second end; a first stem having a distal end and a proximal end, the proximal end attached substantially perpendicularly to the first end of the spinning bar; a second stem having a distal end and a proximal end, the proximal end of the second stem substantially perpendicularly attached to the second end of the spinning bar; a first mounting device attached to the distal end of the first stem; and a second mounting device attached to the distal end of the second stem. The support member holds the carousel relative to a surface and the carousel is spinnable on the spinning bar of the support member for presenting multiple display panels to a customer upon spinning the carousel.

In one embodiment, the securing members comprise flat pieces of material secured at an acute angle to the display panel holders. In another embodiment, the securing members comprise clips. In another embodiment, the display panel holder has a pocket for holding information cards.

In another embodiment, the first and second mounting devices comprise hooks for insertion into a vertical surface having preformed holes. In yet another embodiment, the first and second mounting devices comprise generally U-shaped brackets with outwardly directed flanges or edge portions along each of the free ends which are dimensioned for resilient engagement with the channels of a conventional track member on the front edge of a store shelf.

The support member and the carousel may be provided together with a representative merchandise items and/or other display panels affixed thereto by a manufacturer as a kit for use by the retailer. As promotional items change, different display panels can be provided by the manufacturer to the retailer. Alternatively, a retailer could use the support member and carousel to display promotions and instructional materials and change them periodically as desired.

The foregoing and other features and advantages of the invention will be more readily understood and fully appreciated from the following detailed description, taken in conjunction with the accompanying drawings.

DETAILED DESCRIPTION OF THE PREFERRED EMBODIMENTS

Figure 1A:
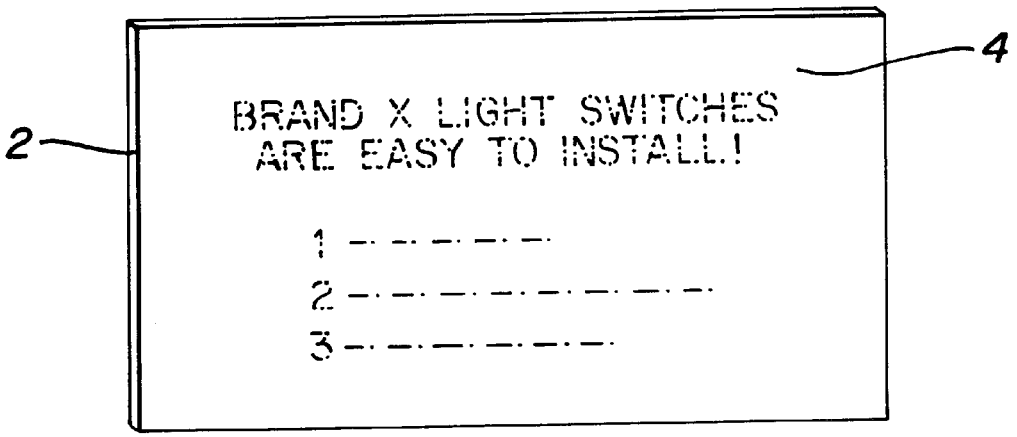
FIGS. 1A and 1B are perspective views of representative display panels to be supported for display by the display apparatus of the present invention.
Figure 1B:
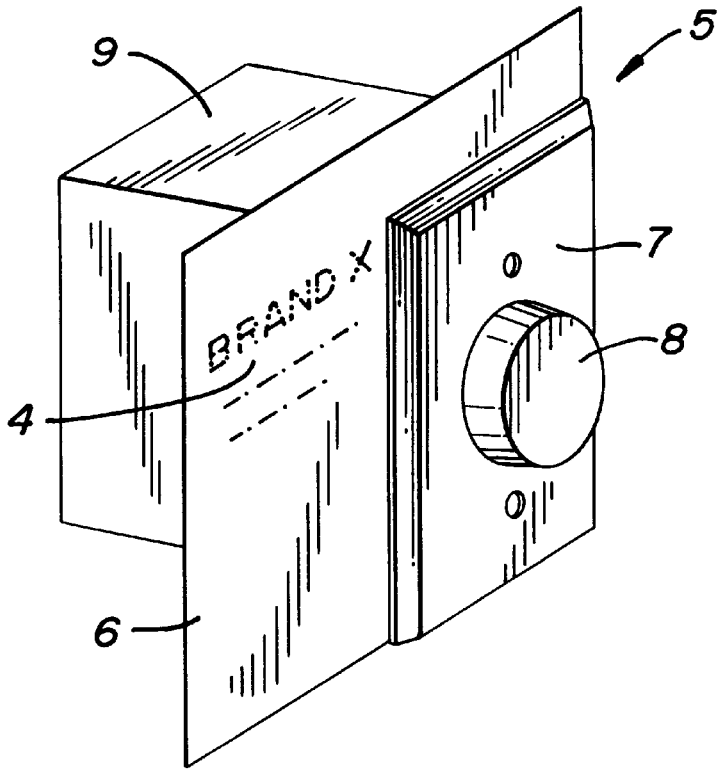

FIGS. 1A and 1B show two types of display panels which may be displayed using a display apparatus of the present invention. FIG. 1A shows a relatively thin information bearing card 2 which bears indicia 4 which serves as one type of display panel. The indicia 4 may be instructive as shown, or it may bear advertising material. The indicia 4 may be printed on both sides of card 2 for reversible use. The card 2 may be laminated for durability. FIG. 1B shows an item of merchandise 5 which serves as another type of display panel. The merchandise item selected for illustration is a dimmer-type electrical light switch having a wall plate 7, an operating knob 8, and a back-body 9 for installation in a wall opening. The item of merchandise 5 is preferably mounted on an information bearing card 6 which bears indicia 4. Preferably, this second type of display panel is completely uncovered, i.e. not wrapped in plastic, so as not to inhibit a shopper's ability to touch the merchandise 5.

Figure 2:
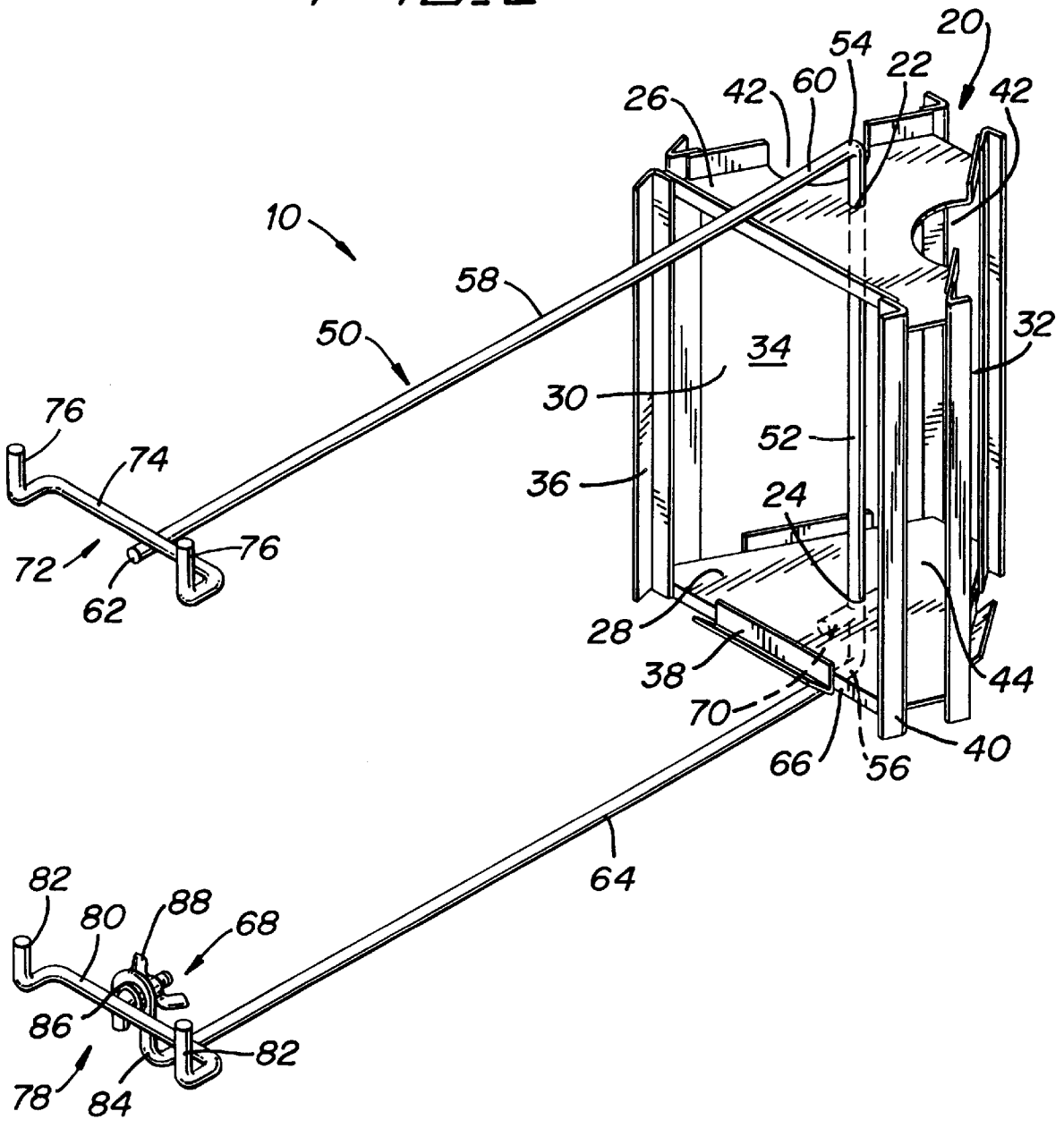
FIG. 2 is a perspective view of the display apparatus in one embodiment of the present invention.

FIG. 2 shows the display apparatus 10 is one embodiment of the invention which is capable of displaying both types of display panels depicted in FIGS. 1A and 1B. The display apparatus 10 comprises a carousel 20 and a support member 50. The carousel 20 and the support member 50 are preferably both made from metal for strength and durability, but other materials could be used. The carousel 20 is spinnable on spinning bar 52 of the support member 50. The carousel 20 is provided with a first plate 26 and a second plate 28, preferably parallel to the first plate 26. A hole 22 is located on the first plate 26 and a hole 24 is located on the second plate 28. The holes 22 and 24 are preferably centrally located on the first plate 26 and the second plate 28, respectively. The spinning bar 52 passes through holes 22 and 24. The diameter of the holes 22 and 24 is preferably slightly larger than the diameter of the spinning bar 52 to allow the carousel 20 to spin freely on the spinning bar 52.

The carousel 20 is preferably provided with at least three display panel holders, designated generally as 30, 32, and 34, each for supporting a single display panel. Of course, any number of display panel holders could be employed. For example, two display panel holders could be used and connected by a first plate and a second plate shaped as long rectangles. Alternatively, four display panel holders could be used and connected by square shaped first and second plates. As shown in FIG. 1, each display panel holder is rectangularly shaped. Although other shapes could be used, a rectangle shape works best with rectangularly shaped display panels, which are the easiest and most economical to produce. Each display panel holder is provided with at least one securing member for supporting a display panel against the carousel 20, allowing a shopper to spin the carousel 20 without causing the display panels to fall off. Three securing members 36, 38, and 40 are shown on display panel holder 30. By example only, the left and right securing members 36 and 40, respectively, are shown to be the length of the edges of the display panel holder 30 and the bottom securing member 38 is shown centrally located on the bottom edge of the display panel holder 30. Each securing member 36, 38, and 40 comprises a strip of material secured at an acute angle to the display panel holder 30. If the carousel 20 is made from metal, the securing members 36, 38, and 40 could comprise V-shaped strips of metal fastened to and connecting and separating the first and second plates 26 and 28.

In one manner of use, the carousel 20 may be held to a vertical surface by the support member 50, as will be described, such that first plate 26 is vertically above second plate 28. A display panel held by the carousel 20 would be supported on the bottom by securing member 38, so that the display panel does not slide off the carousel 20 due to gravity. When a user spins the carousel 20, the display panel is prevented from sliding off to the left or right by securing members 36 and 40. The display panel can be inserted into the carousel 20 in one of two ways. First, the display panel can be inserted from the top, adjacent the first plate 26, and permitted to slide between securing members 36 and 40 until the panel abuts bottom securing member 38. Alternatively, if the display panel is flexible enough, the display panel can be arched by a user's fingers until it fits between the two securing members 36 and 40, and then released so that the securing members 36 and 40 surround the panel. Again, the panel can then be permitted to slide between the securing members 36 and 40 until it abuts bottom securing member 38.

Figure 3A:
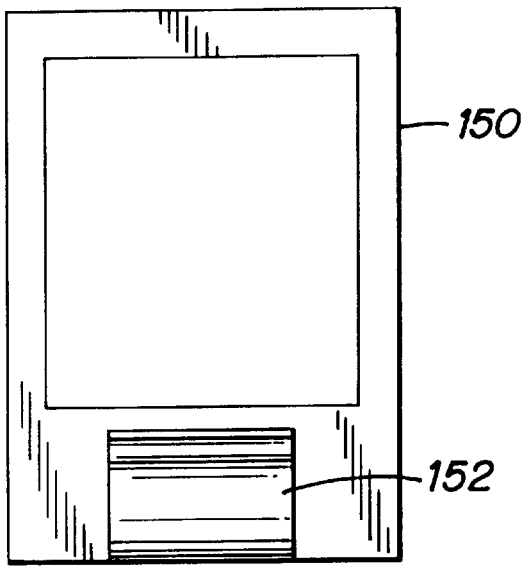
FIG. 3A is a front plan view of a display panel holder having a clip and FIG. 3B is a side view of a display panel holder having a clip.
Figure 3B:
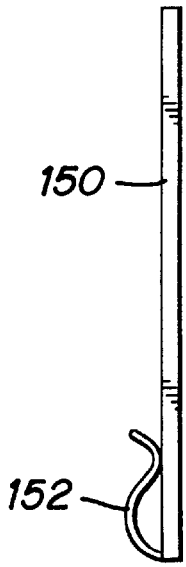
Figure 4:
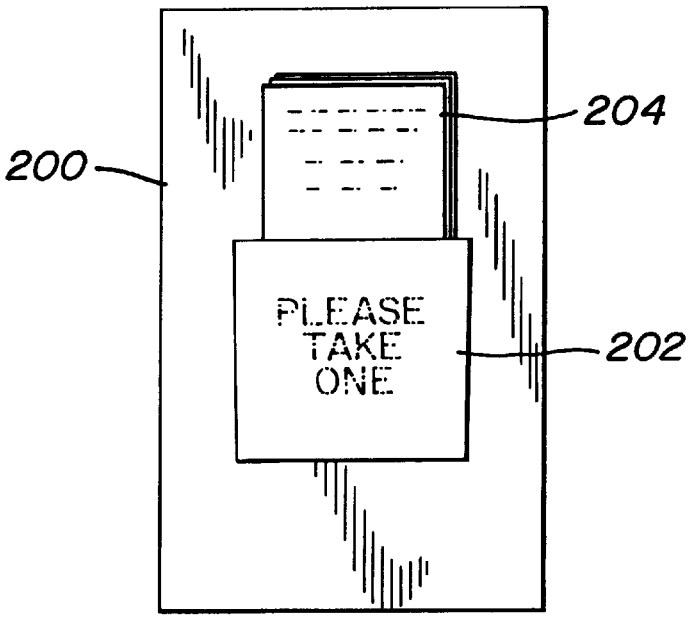
FIG. 4 is a front play view of a display panel holder having a pocket.

In an alternate embodiment, as shown in FIGS. 3A and 3B, a display panel holder 150 may be provided with a display panel securing member 152 in the form of a clip. One or more such clips 152 may be used along the edge of display panel holder 150 to secure a display panel to the holder 150. The holder 150 may be a solid wall or may be window-like as shown, as long as clip 152 can push against a part of the holder 150. Although only an S-shaped clip 152 is shown, other securing means could be used such as hook and loop-type fasteners, snaps, paper clips, etc. In another alternate embodiment, as shown in FIG. 4, display panel holder 200 is provided with a pocket 202 for holding information cards 204. Information cards 204 may be taken by customers wishing to bring home information regarding a particular product displayed or service provided. Display panel holders 150 and 200 may be used in place of any or all display panel holders 30, 32, and 34 as best suits the needs of the individual manufacturer or retailer. Alternatively, display panel holder 200 may be provided as a display panel which can slide in display panel holders 30, 32, and 34 for converting these display panel holders into information card holders.

In some instances, where arching the display panel is not possible, it may be necessary to slide a display panel as depicted in FIG. 1B from the top of the carousel 20. Due to the dimension of the back-body 9, such a sliding operation would not be possible without an access cut-out 42, depicted in connection with display panel holders 32 and 34 in FIG. 2. The access cut-out 42 allows a back-body 9 to slide past the first plate 26 and into the central area of the carousel 20 as the information bearing card 6 slides through the securing members 36 and 40. Although access cut-outs 42 are shown in connection with two display panel holders, each display panel holder could be provided with an access cut-out 42 or only one display panel holder could by provided with an access cut out 42. Although the access cut-outs 42 are shown as centrally located with respect to an edge of a display panel, the access cut-outs 42 could be positioned on a left or right side to accommodate back-bodies 9 which are located on the side, such as that depicted in FIG. 1B. Also, although access cut-outs 42 are shown as semi-circular shaped, other shapes are fully within the scope of this invention.

Further as shown in FIG. 2, the display panel holders 30, 32, and 34 are not necessarily connected to one another. Preferably, the display panel holders 30, 32, and 34 are connected to the first plate 26 and the second plate 28 such that slots 44 are formed between display panel holders 30, 32, and 34. The slots 44 extend the length of the display panel holders and are preferably of a width large enough to insert an average sized finger. Thus, in use, a customer wishing to view all sides of the carousel 20 could insert his/her finger in a slot 44 and spin the carousel 20 about the spinning bar 52. If the slots 44 are not present, and instead the display panel holders 30, 32, and 34 are connected to one another, then a customer could hook a finger onto the securing members 36 and 40 to spin the carousel.

The support member 50 is preferably a generally U-shaped member made of metal or other strong material and preferably has a circular cross-sectional shape. The spinning bar 52, as previously described, passes through the holes 22 and 24 of the carousel 20. A first end 54 of the spinning bar 52 is connected to a proximal end 60 of a first stem 58 of the support member 50. A second end 56 of the spinning bar 52 is connected to a proximal end 66 of a second stem 64 of the support member 50. The connections of the first and second ends of the spinning bar 52 to the proximal ends 60 and 66 of the stems 58 and 64 may be made by welding, adhering, or the like, or alternatively, the stems 58 and 64 and the spinning bar 52 may be made from one integral piece of metal. If the stems 58 and 64 and the spinning bar 52 are made from a single integral rod of metal, then the rod could either be inserted through the holes 22 and 24 and then bent to form the U-shape, or the rod could be bent once, then inserted through the holes 22 and 24, and then bent again to form the U-shape.

Figure 5:
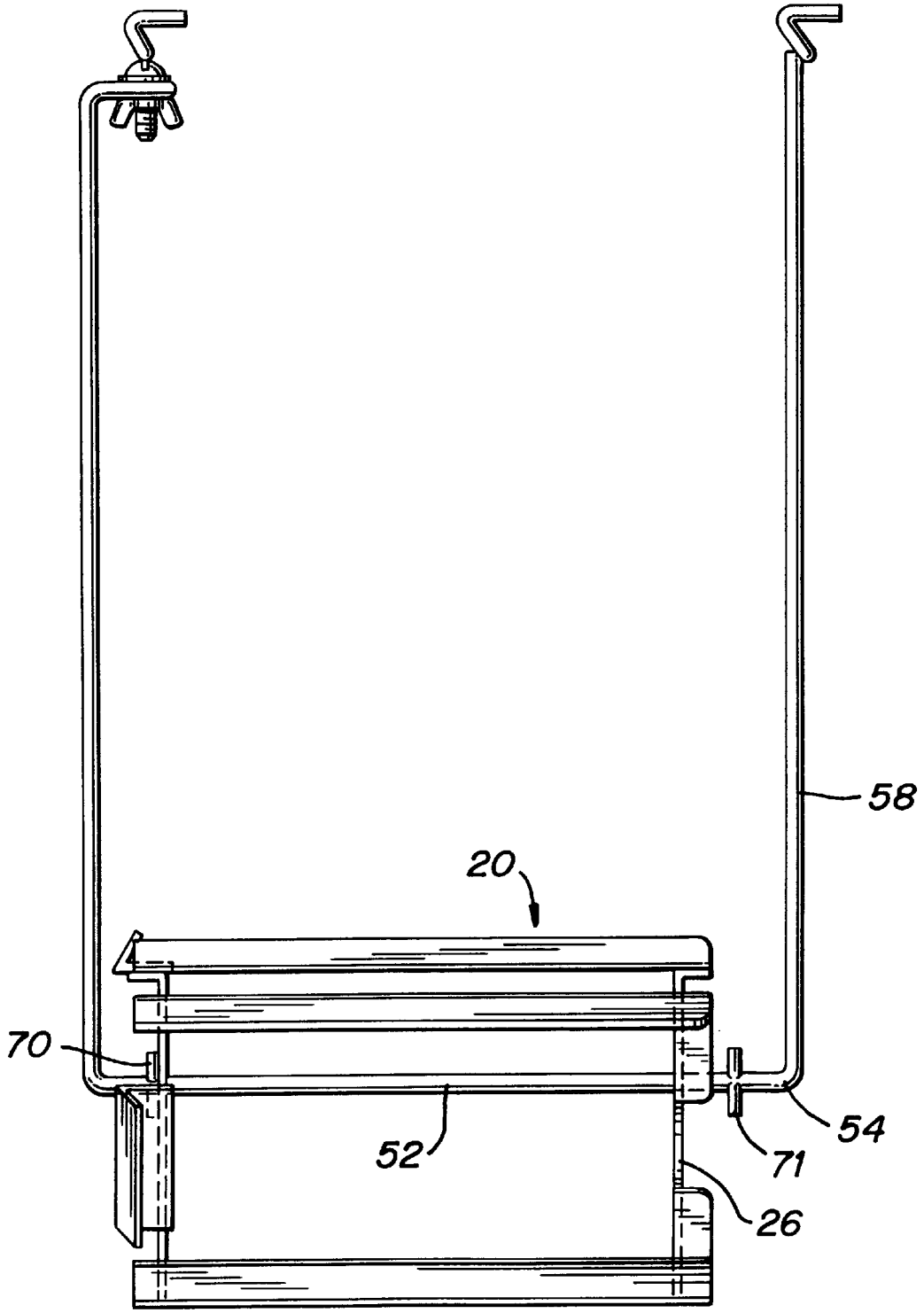
FIG. 5 is a side view of the display apparatus of FIG. 2 having a slide preventing bar.

In one embodiment, the carousel 20 may be attached to a vertical surface such that the first plate 26 is vertically above the second plate 28 and both planes of the plates 26 and 28 intersect the plane of the vertical surface substantially perpendicularly. In this embodiment, a gravity bar 70 (shown in phantom in FIG. 2) is preferably attached perpendicularly to the spinning bar 52 exteriorly of the carousel 20. The second plate 28 of the carousel 20 may thus rest and spin upon the gravity bar 70. Without the gravity bar 70, the second plate 28 would rest on a portion of the second stem 64 which would tend to scratch and potentially wear down the second stem 64 during spinning. In addition, spinning of the carousel 20 may be obstructed without the gravity bar 70. As can be seen in FIG. 5, the display holders, the securing members, and the second plate do not necessarily all lie within the same plane; therefore, there would not be enough clearance to successfully spin the carousel 20 if the second plate 28 were to directly abut the second stem 64. The gravity bar 70 should be positioned on the spinning bar 52 to provide adequate clearance for the carousel to spin freely. The gravity bar 70 may be attached to the spinning bar 52 by welding, adhering, or the like.

A first mounting device 72 is attached to the distal end 62 of the first stem 58 and a second mounting device 78 is attached to the distal end 68 of the second stem 64. The first mounting device 72 comprises a mounting bar 74 and two hooks 76, one hook 76 attached to each end of the mounting bar 74. The second mounting device 78 also comprises a mounting bar 80 with two hooks 82, one hook 82 attached to each end of the mounting bar 80. The first mounting device 72 is preferably permanently and perpendicularly attached to the distal end 62 of the first stem 58 at a central location along the mounting bar 74. The attachment may be made by welding, adhering, or the like. The second mounting device 78 is preferably removably and perpendicularly attached to the distal end 68 of the second stem 64. In order to removably attach the second mounting device 78 to the second stem 64, the distal end 68 of the second stem 64 may be provided with a perpendicular and preferably integral stem hook 84 and the mounting bar 80 may be provided with a centrally located, perpendicularly and permanently attached screw 86 which can pass through the stem hook 84 and be secured thereto by a nut 88, such as a wingnut.

Support member 50 is designed for mounting upon a vertical surface having at least two pairs of preformed openings horizontally spaced for alignment with hooks 76 and 82. The openings may be two pairs of the plurality of evenly spaced openings arranged in perpendicular rows and columns in a sheet of so-called pegboard such as is often provided as a vertical support for rods upon which packaged merchandise items are hung.

In use, the hooks 76 of the first mounting device 72 are inserted into a pair of holes at a desired location. Then, the hooks 82 of the second mounting device 78 are inserted into another pair of holes and then attached via the nut to the stem hook 84 of the second stem 64. The removability of the second mounting device makes insertion of both stems of the support member 50 into a pegboard possible. It also allows a user to insert the second mounting device 78 in any direction, i.e., the hooks 82 may point up, down, to the right, or to the left. Although the support member 50 would be securely attached to the pegboard when hooks 82 are pointing in any direction, the support member 50 is most securely attached when the hooks 76 and 82 point in opposite directions. In another embodiment, the first mounting device 72 may also be removable, with a stem hook, similar to stem hook 84, provided on the distal end 62 of the first stem 58.

It should be noted that the display device 10 is not limited to the vertical orientation shown in FIG. 2. The hooks 76 and 82 are spaced such that insertion of the first and second mounting devices 72 and 78 into a pegboard having evenly spaced holes (typically 3" apart) is allowed in any direction (other than diagonal). Thus, the support member 50 could be attached to a pegboard such that the spinning bar 52 is horizontal relative to the vertical surface of the pegboard. In such an embodiment, gravity bar 70 is not necessary, but could still be used to prevent the carousel 20 from sliding too close to the second stem 64. As shown in FIG. 5, an additional sliding preventer bar 71 could be used near the first end 54 of the spinning bar 52 and exteriorly of the first plate 26 to prevent the carousel 20 from sliding too close to the first stem 58. Securing members 36 and 40 in this orientation prevent a display panel from sliding off the carousel 20 due to gravity. Thus the display device 10 can exhibit display panels having indicia printed in any direction.

Figure 6:
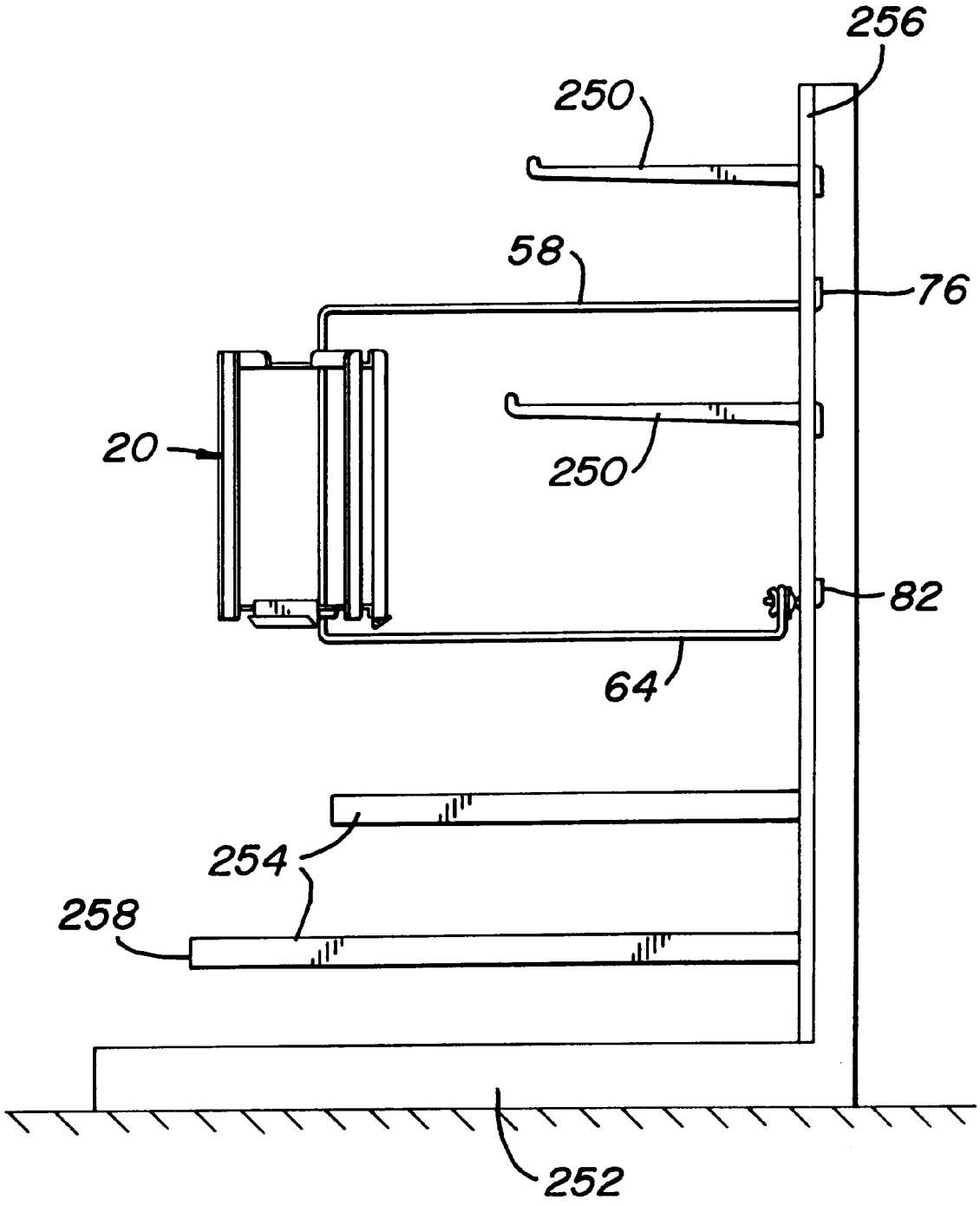
FIG. 6 is a side view of a retail store aisle showing the display apparatus of FIG. 2 attached to a pegboard.
Figure 7:
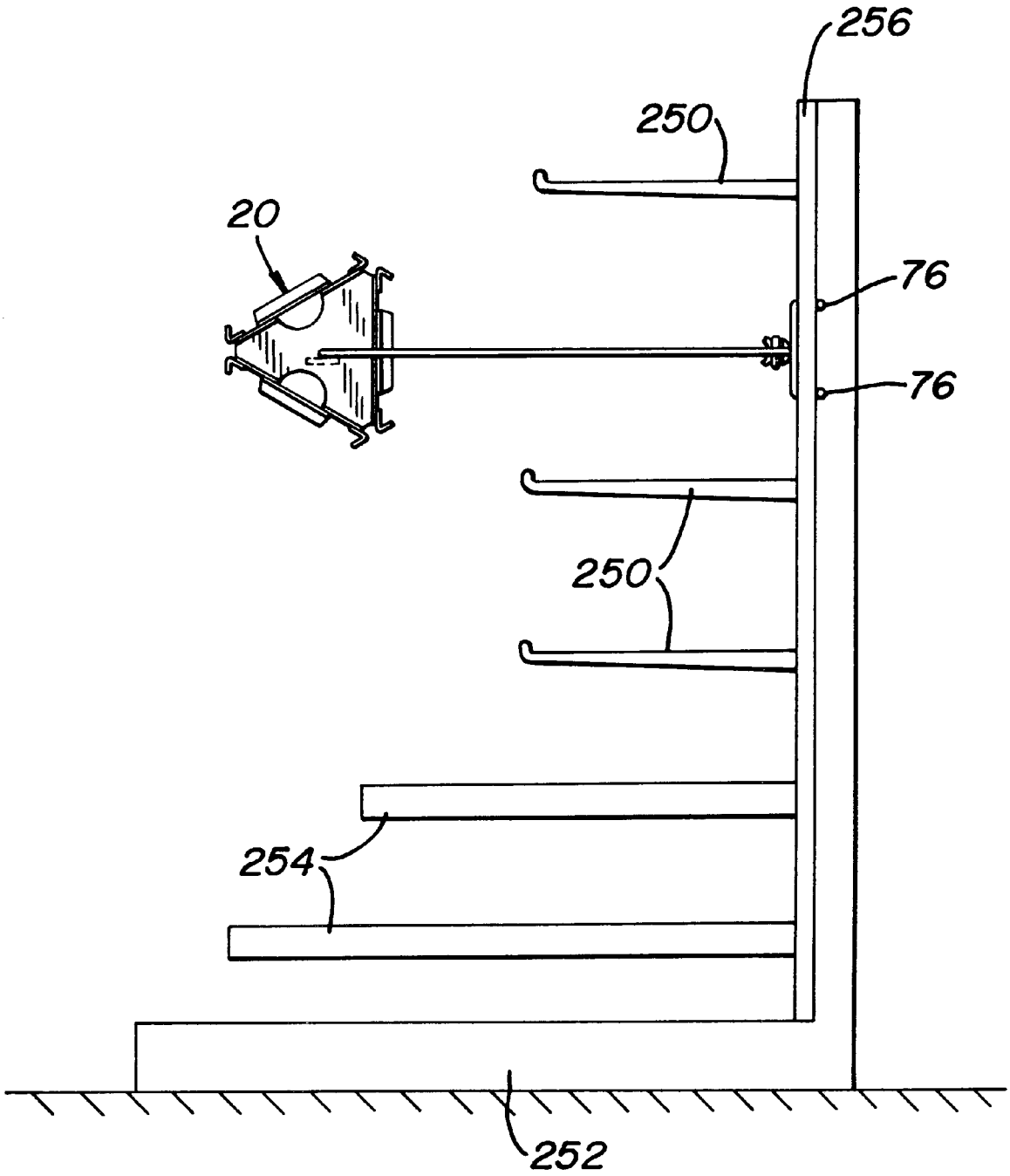
FIG. 7 is a side view of a retail store aisle showing the display apparatus of FIG. 5 attached to a pegboard.

Support member 50 is preferably provided with first stem 58 and second stem 64 of sufficient length to clear any pegs used behind the carousel 20. As shown in FIG. 6, a typical peg used in hardware stores and the like is an 8 inch peg 250 hung on a pegboard 256. Thus, a suitable length for first and second stems 58 and 64 would be between 11 and 17 inches, and is preferably about 14 inches. Where the carousel extends inwardly approximately 3 inches at a comer, a clearance between an end of an 8 inch peg 250 and the carousel is provided, and is preferably about 3 inches. A base 252 in an aisle of a retail store is approximately 21" wide. Thus, the carousel 20 is within the width of the base 252 and thus does not present a hazard to customers walking through an aisle. Store shelves 254 are shown for exemplary purposes. FIG. 7 shows the same store aisle as in FIG. 6 but with the support member 50 rearranged such that spinning bar 52 is horizontally arranged relative to the vertical surface or pegboard 256.

Figure 8:
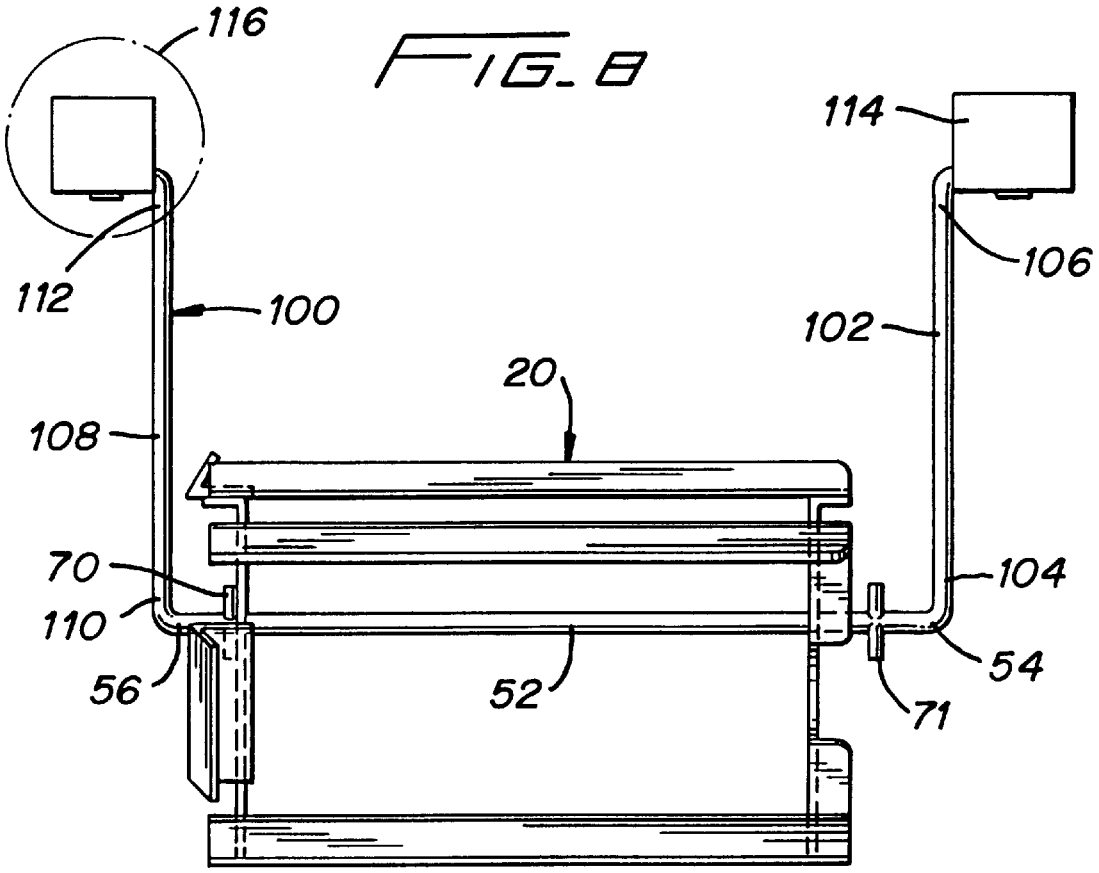
FIG. 8 is a top view of a display apparatus in another embodiment of the invention.

In an alternate embodiment, the display device of the present invention could be mounted within the channels of a conventional track member on the front edge of a store shelf. Turning now to FIG. 8, a second form of support member, indicated by reference numeral 100, is provided for use alternatively to support member 50. The carousel 20 is supported on a spinning bar 52 as previously described. Support member 100 comprises a first stem 102 and a second stem 108. The first stem 102 has a proximal end 104 attached to the first end 54 of the spinning bar 52. The second stem 108 has a proximal end 110 attached to the second end 56 of the spinning bar 52. The spinning bar 52, as previously described, preferably has a circular cross-section for allowing an uninterrupted spinning motion of the carousel 20. Because the spinning bar 52 is held parallel to a track member on the front edge of a store shelf, the carousel 20 can slide back and forth along the sliding bar 52. To prevent the carousel 20 from sliding too much on spinning bar 52 and to allow for adequate clearance of the carousel 20 in relation to the first stem 102 and the second stem 104, sliding preventer bars 70 and 71 are preferably attached to the spinning bar 52.

Figure 9:
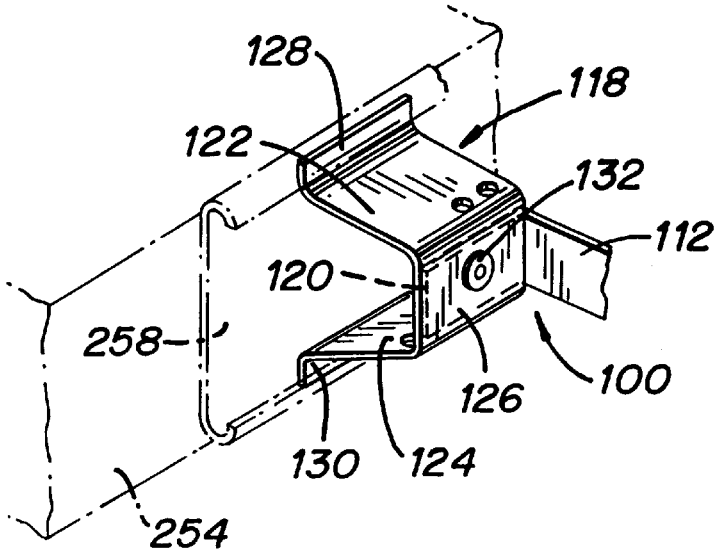
FIG. 9 is a perspective view of reference number 116 of FIG. 8.

The distal end 106 of the first stem 102 is provided with a first mounting device 114 and the distal end 112 of the second stem 108 is provided with a second mounting device 116. The first stem 102 and the second stem 108 may be flat strips of material as opposed to having a circular cross-section and may be secured to the spinning bar 52 in a conventional fashion, such as by welding. As shown in FIG. 9, the second mounting device 116 comprises substantially U-shaped bracket 118 and a further L-shaped bracket having essentially planar portions 112 (distal end of second stem 108) and 120 disposed in perpendicular planes. U-shaped bracket 118 includes a pair of arms 122 and 124, connected by medial portion 126 and having outwardly directed flanges 128 and 130 extending along their respective free ends. Portion 120 of the L-shaped bracket is fixedly attached to medial portion 126 of U-shaped bracket 118 by any desired means, such as rivet 132. The first mounting device 114 may be identical or the mirror image of second mounting device 116.

Support member 100 is designed for mounting upon a conventional track member such as those commonly attached to the front edges of store shelves for holding price tags, or the like, in proximity to merchandise stocked on the shelves. A fragment of such a track member is shown in phantom lines in FIG. 9, denoted by reference numeral 258 and mounted on the front edge of store shelf 254. A limited amount of resilience of U-shaped bracket 118 permits the free ends of arms 122 and 124 thereof to be moved a short distance toward one another, whereby flanges 128 and 130 may be inserted in the horizontally disposed channels on each side of track member 258. Alternately, flanges 128 and 130 may slide into the spaced channels of track member 258 from one end thereof. Because the support member 100 attaches to an end of a shelf 254 as opposed to a pegboard 256, the first stem 102 and second stem 108 need only be as long as that which will allow clearance for the carousel 20 to spin freely about spinning bar 52. The carousel 20 preferably does not extend beyond the base 252 when attached to a shelf 254.

From the foregoing, it will be appreciated that the present invention provides a unique and commercially effective means of displaying merchandise and other display panels in a retail setting. An actual item or product corresponding to that which the customer would normally purchase in a closed package, is supported in a conspicuous position and orientation for visual inspection and, where appropriate, for manual manipulation by the customer. Support members are disclosed in two embodiments, for alternate use by removable attachment to structure, e.g., a pegboard or shelf-front track member, normally found in retail establishments. Advertising, promotional, or instructional materials may be supported on the same display device without obstructing any merchandise items being displayed or sold. Interchangeability of display panels is simple and thus the display device may be continually updated and reused.

The above description is illustrative and not restrictive. Many variations of the invention will become apparent to those of skill in the art upon review of this disclosure. The scope of the invention should, therefore, be determined not with reference to the above description, but instead should be determined with reference to the appended claims along with their full scope of equivalents.

What is claimed is:

1. A display apparatus for displaying to shoppers in a retail store environment multiple display panels, each display panel having at least one substantially planar surface, the display apparatus comprising:

a) a carousel having i) a first plate and a second plate, parallel to the first plate, each plate having a hole;

ii) at least three display panel holders, each holder separating the first plate from the second plate; and, iii) at least one securing member on each holder adapted to support a substantially planar surface of a display panel to the carousel;

b) a support member having i) a spinning bar passing through each hole of the first and second plate, the spinning bar having a first and second end;

ii) a first stem having a distal end and a proximal end, the proximal end attached substantially perpendicularly to the first end of the spinning bar;

iii) a second stem having a distal end and a proximal end, the proximal end of the second stem substantially perpendicularly attached to the second end of the spinning bar;

iv) a first mounting device attached to the distal end of the first stem;

v) a second mounting device attached to the distal end of the second stem; and vi) wherein the support member holds the carousel relative to a surface and wherein the carousel is spinnable on the spinning bar of the support member.

2. The display apparatus of claim 1 wherein each mounting device comprises a mounting bar having two ends and a mounting hook attached to each end of the mounting bar.

3. The display apparatus of claim 2 wherein the distal end of the first stem is permanently attached to a central area of the mounting bar of the first mounting device.

4. The display apparatus of claim 3 wherein the distal end of the second stem is removably attached to a central area of the mounting bar of the second mounting device.

5. The display apparatus of claim 4 further comprising a stem hook at the distal end of the second stem, a screw centrally attached to the mounting bar of the second mounting device and adapted to pass through the stem hook, and a nut for securing the screw of the second mounting device to the stem hook of the second stem.

6. A display apparatus for displaying multiple display panels relative to a mounting surface, each display panel having at least one substantially planar surface, the display apparatus comprising:

a carousel adapted to hold multiple display panels, the carousel having a first plate and a second plate, parallel to the first plate, wherein each plate is provided with a centrally located hole, and a support member adapted to secure the carousel to the mounting surface, wherein the carousel is spinnable on the support member and spinnable relative to the mounting surface, the support member having a spinning bar passing through each hole of the first and second plate, the spinning bar having a first and second end, the support member further having a first stem having a distal end and a proximal end, the proximal end attached substantially perpendicularly to the first end of the spinning bar, a first mounting device attached to the distal end of the first stem and a second stem having a distal end and a proximal end, the proximal end of the second stem attached substantially perpendicularly to the second end of the spinning bar, a second mounting device attached to the distal end of the second stem, wherein each mounting device comprises a mounting bar having two ends and a mounting hook attached to each end of the mounting bar, and wherein the distal end of the first stem is permanently attached to a central area of the mounting bar of the first mounting device and the distal end of the second stem is removably attached to a central area of the mounting bar of the second mounting device.

7. The display apparatus of claim 6 wherein the carousel comprises:

at least three display panel holders, each holder separating the first plate from the second plate.

8. The display apparatus of claim 7 further comprising at least one securing member on each holder adapted to support a substantially planar surface of a display panel to the carousel.

9. The display apparatus of claim 8 wherein each securing member is a flat strip of material which forms an acute angle with a display panel holder.

10. The display apparatus of claim 9 wherein each display panel holder has four edges and three separate securing members, each securing member located along a different edge of a display panel holder whereby a user may slide a display panel in a display panel holder from an edge not obstructed by a securing member.

11. The display apparatus of claim 8 wherein at least one securing member is a clip.

12. The display apparatus of claim 8 wherein at least one securing member is a pocket.

13. The display apparatus of claim 7 further comprising a finger slot between each display panel holder for assisting a user in spinning the carousel.

14. The display apparatus of claim 7 wherein the first plate is provided with at least one cut-out adjacent a display panel holder for allowing a back-body of a display panel to pass.

15. The display apparatus of claim 14 wherein each cut-out is semi-circular.

16. The display apparatus of claim 6 wherein the first stem and the second stem have circular cross sections.

17. The display apparatus of claim 6 wherein the first stem and the second stem each have a length between 11 and 17 inches.

18. The display apparatus of claim 6 further comprising a gravity bar attached to the spinning bar exteriorly of the second plate for supporting the carousel above the second stem.

19. The display apparatus of claim 18 further comprising a sliding preventer bar attached to the spinning bar exteriorly of the first plate.

* * * * *